US010955787B2

(12) United States Patent
Tanio

(10) Patent No.: US 10,955,787 B2
(45) Date of Patent: Mar. 23, 2021

(54) SHEET CONVEYING DEVICE, IMAGE FORMING APPARATUS

(71) Applicant: KYOCERA Document Solutions Inc., Osaka (JP)

(72) Inventor: Koji Tanio, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/748,005

(22) Filed: Jan. 21, 2020

(65) Prior Publication Data

US 2020/0233362 A1 Jul. 23, 2020

(30) Foreign Application Priority Data

Jan. 22, 2019 (JP) ..... JP2019-008243

(51) Int. Cl.

| | |
|---|---|
| ***B65H 29/58*** | (2006.01) |
| ***G03G 15/00*** | (2006.01) |
| ***B65H 43/06*** | (2006.01) |
| ***B65H 29/14*** | (2006.01) |
| ***B65H 31/00*** | (2006.01) |

(52) U.S. Cl.

CPC ..... *G03G 15/6529* (2013.01); *B65H 29/14* (2013.01); *B65H 29/58* (2013.01); *B65H 31/00* (2013.01); *B65H 43/06* (2013.01)

(58) Field of Classification Search

CPC .... G03G 15/6529; B65H 29/14; B65H 29/58; B65H 31/00; B65H 43/06

USPC ..... 271/184

See application file for complete search history.

(56) References Cited

U.S. PATENT DOCUMENTS

| | | | | |
|---|---|---|---|---|
| 7,644,921 | B2 * | 1/2010 | Hattori | G03G 15/6529 271/265.01 |
| 8,439,357 | B2 * | 5/2013 | Arikawa | G03G 15/234 271/184 |
| 8,991,823 | B2 * | 3/2015 | Sato | B65H 29/58 271/303 |
| 10,399,804 | B2 * | 9/2019 | Ogura | B65H 29/52 |

FOREIGN PATENT DOCUMENTS

JP 2007204228 A 8/2007

* cited by examiner

*Primary Examiner* — Leslie A Nicholson, III

(74) *Attorney, Agent, or Firm* — Alleman Hall Creasman & Tuttle LLP

(57) ABSTRACT

A flange portion extending outward from a main shaft portion is disposed outside a side plate with respect to a position of an attachment member in a main direction when the attachment member is mounted to the side plate. A restriction slot is formed in the attachment member such that the flange portion can be fitted in and pass through the restriction slot. In the middle of the process where the attachment member is mounted to a second side plate in the main direction, the flange portion is fitted in the restriction slot, thereby the sheet detecting member is restricted from rotating, and one of a pair of projection portions of a sheet guide member is inserted in a hole of the attachment member.

6 Claims, 9 Drawing Sheets

SHEET CONVEYING DEVICE, IMAGE FORMING APPARATUS

INCORPORATION BY REFERENCE

This application is based upon and claims the benefit of priority from the corresponding Japanese Patent Application No. 2019-008243 filed on Jan. 22, 2019, the entire contents of which are incorporated herein by reference.

BACKGROUND

The present disclosure relates to a sheet conveying device having a function to detect sheets stacked on a tray in excess of a predetermined height, and relates to an image forming apparatus including the sheet conveying device.

An image forming apparatus typically includes a sheet conveying device that conveys a sheet in a main body portion and discharges the sheet onto a discharge tray. In addition, the sheet conveying device may include a mechanism for detecting sheets stacked on the discharge tray in excess of a predetermined level. The mechanism is referred to as, for example, a full stack detection mechanism.

The full stack detection mechanism includes a rotatably supported sheet detecting member and a detection sensor. The sheet detecting member includes a shaft portion, a contact portion, and a detected portion. The shaft portion is rotatably supported by a pair of side plates disposed to face each other. The pair of side plates are a part of the main body portion.

The contact portion is formed to extend from the shaft portion toward above the discharge tray. The detected portion is formed to extend from a portion of the shaft portion close to one end thereof toward an area other than above the discharge tray.

When the contact portion receives a contact pressure from the sheets that have been stacked on the tray in excess of a predetermined height, the sheet detecting member rotates. The detection sensor detects the detected portion when the sheet detecting member rotates in excess of a predetermined angle.

SUMMARY

A sheet conveying device according to an aspect of the present disclosure includes a pair of conveyance rollers, a sheet detecting member, a sheet guide member, a first side plate, a second side plate, an attachment member, and a detection sensor. The pair of conveyance rollers convey a sheet onto a tray. The sheet detecting member includes a main shaft portion, a contact portion, and a detected portion. The main shaft portion is formed to extend in a main direction perpendicular to a sheet conveyance direction in which the sheet is conveyed. The contact portion and the detected portion are formed to extend in different directions from the main shaft portion. The sheet detecting member rotates around the main shaft portion while the contact portion comes in contact with the sheet stacked on the tray. The sheet guide member is disposed parallel with the sheet detecting member and includes a guide portion, a first projection portion, and a second projection portion. The guide portion guides the sheet that is being conveyed. The first projection portion and the second projection portion project in the main direction respectively from opposite ends of the guide portion in the main direction. The sheet guide member is supported in such a way as to swing around the first projection portion and the second projection portion and changes directions to guide the sheet. A first support hole and a second support hole are formed in the first side plate. A first supported portion formed at a first end of the main shaft portion is inserted in the first support hole. The first projection portion is inserted in the second support hole. The second side plate is disposed to face the first side plate in the main direction. The attachment member is mounted to an outer surface of the second side plate. The detection sensor detects the detected portion. A third support hole, a large opening, and a communication opening are formed in the second side plate. A second supported portion formed on a side of a second end of the main shaft portion is inserted in the third support hole. The large opening is larger than the third support hole. The communication opening is communicated with the large opening and the third support hole. The second supported portion passes through the communication opening. A fourth support hole in which the second projection portion is inserted is formed in the attachment member. The attachment member forms a space between the attachment member and the second side plate such that the detection sensor is disposed in the space. The sheet detecting member includes a flange portion disposed outside the attachment member and formed to extend, at the second end of the main shaft portion, from the main shaft portion outward in a radial direction of the main shaft portion. A restriction slot is formed in the attachment member such that the flange portion can be fitted in and pass through the restriction slot. The attachment member is moved in the main direction to pass a first position until it reaches a second position, thereby the attachment member is mounted to the second side plate. When the attachment member passes the first position, the flange portion is fitted in the restriction slot, and the second projection portion is inserted in the fourth support hole in a state where the sheet detecting member is restricted from rotating. After the attachment member passes the first position and before it reaches the second position, the flange portion passes through the restriction slot and is disposed outside the attachment member, thereby a restriction on the rotation of the sheet detecting member is released.

An image forming apparatus according to another aspect of the present disclosure includes the sheet conveying device and a print device configured to form an image on a sheet conveyed by the sheet conveying device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 10]

An image forming apparatus 10 according to an embodiment executes a print process to form an image on a sheet 9.

Figure 1:
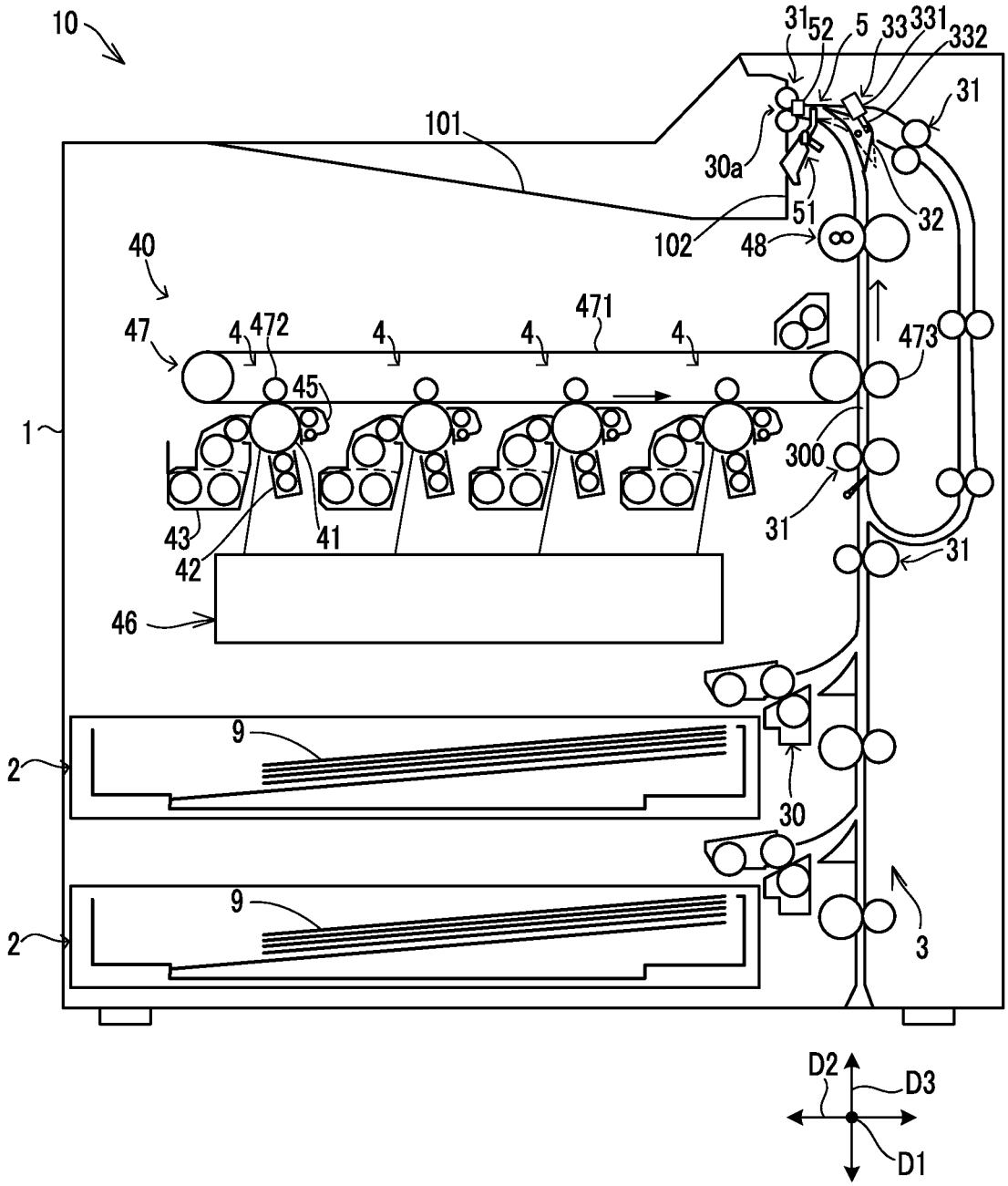
FIG. 1 is a configuration diagram of an image forming apparatus according to an embodiment.

In the example shown in FIG. 1, the image forming apparatus 10 executes the print process by an electrophotographic method. The sheet 9 is a sheet-like image formation medium such as a sheet of paper or an envelope.

It is noted that the image forming apparatus 10 may execute the print process by another method such as an ink jet method.

As shown in FIG. 1, the image forming apparatus 10 includes a sheet conveying device 3 and a print device 40 provided in a main body portion 1.

The sheet conveying device 3 includes a pair of feed rollers 30 and a plurality of pairs of conveyance rollers 31. The pair of feed rollers 30 feeds sheets 9 stored in a sheet storage portion 2 one by one into a conveyance path 300.

The plurality of pairs of conveyance rollers 31 are configured to rotate while the sheet 9 is held therebetween, thereby conveying the sheet 9 along the conveyance path 300 in the main body portion 1. The plurality of pairs of conveyance rollers 31 convey the sheet 9 along the conveyance path 300, and feed the sheet 9 from the conveyance path 300 onto a discharge tray 101. The plurality of pairs of conveyance rollers 31 are rotationally driven by a motor (not shown).

The print device 40 forms an image on the sheet 9 that is conveyed along the conveyance path 300 by the sheet conveying device 3. The print device 40 includes an image creating device 4, a laser scanning device 46, a transfer device 47, and a fixing device 48. The image creating device 4 includes a drum-like photoconductor 41, a charging device 42, a developing device 43, and a drum cleaning device 45.

Figure 2:
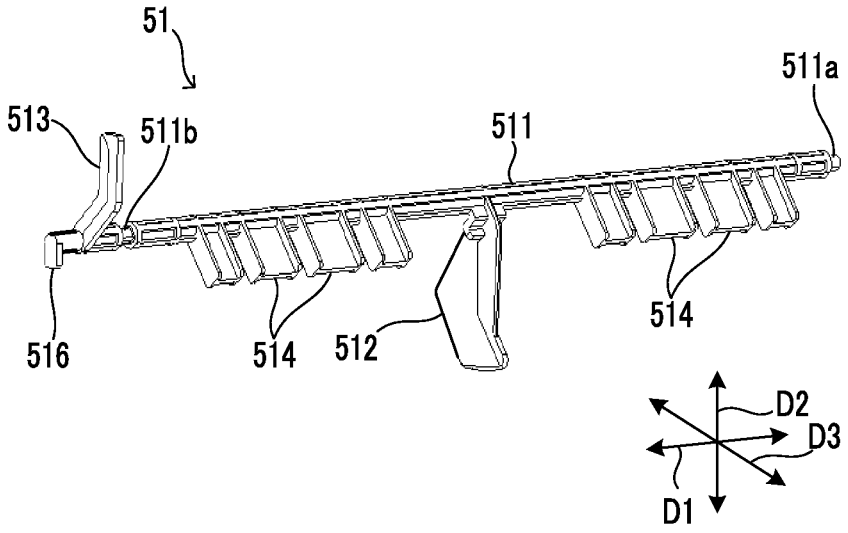
FIG. 2 is a perspective diagram of a sheet detecting member included in the image forming apparatus according to the embodiment.

The image forming apparatus 10 shown in FIG. 2 is a tandem-type color image forming apparatus. As a result, the print device 40 includes a plurality of image creating devices 4 corresponding to a plurality of colors of toner. Furthermore, the transfer device 47 includes an intermediate transfer belt 471, a plurality of belt transfer devices 472 corresponding to the plurality of image creating devices 4, and a sheet transfer device 473.

The print device 40 includes four image creating devices 4 and four belt transfer devices 472 that respectively correspond to four colors of toner: yellow, cyan, magenta, and black.

In each of the image creating devices 4, the photoconductor 41 rotates, and the charging device 42 charges the surface of the photoconductor 41. Furthermore, the laser scanning device 46 writes an electrostatic latent image on the surface of the photoconductor 41 by scanning laser light thereon. The developing device 43 develops the electrostatic latent image as a toner image.

In the transfer device 47, the belt transfer devices 472 transfer the toner images from the surfaces of the photoconductors 41 to the surface of the intermediate transfer belt 471. This allows a color toner image to be formed on the surface of the intermediate transfer belt 471.

The sheet transfer device 473 transfers the color toner image from the intermediate transfer belt 471 to the sheet 9. The fixing device 48 fixes the toner image transferred to the sheet 9, to the sheet 9 by heating and pressing the sheet 9.

A first direction D1 shown in the drawings is perpendicular to a conveyance direction of the sheet 9. The first direction D1 is a horizontal direction extending along rotation axes of two rollers constituting each pair of conveyance rollers 31, and is a width direction of the conveyance path 300. The first direction D1 is also a direction in which the laser scanning device 46 scans the laser light. It is noted that the first direction D1 corresponds to a main direction.

A second direction D2 shown in the drawings is a horizontal direction perpendicular to the first direction D1. A third direction D3 is a vertical direction perpendicular to the first direction D1 and the second direction D2.

Furthermore, the sheet conveying device 3 includes a sheet guide member 32, an actuator 33, and a sheet detecting device 5. The sheet detecting device 5 detects sheets 9 when the sheets 9 are stacked on the discharge tray 101 in excess of a predetermined height. In other words, the sheet detecting device 5 detects that the sheets 9 are stacked on the discharge tray 101 in excess of the predetermined height. The sheet detecting device 5 includes a sheet detecting member 51 and a detection sensor 52.

Figure 3:
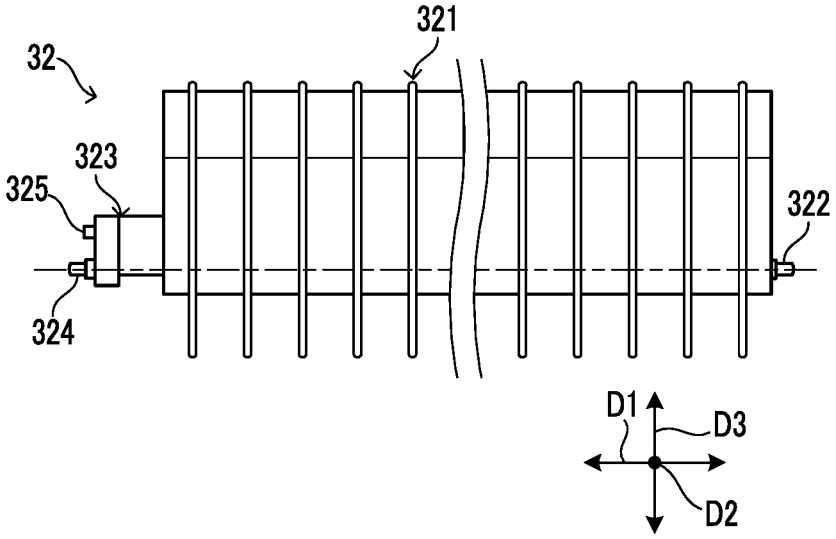
FIG. 3 is a front diagram of a sheet guide member included in the image forming apparatus according to the embodiment.

As shown in FIG. 3, the sheet guide member 32 includes a guide portion 321 and a pair of projection portions 322 and 324. The guide portion 321 is configured to come in contact with a sheet 9 that is being conveyed and guide the sheet 9 in a conveyance direction. The sheet guide member 32 is disposed parallel with the sheet detecting member 51.

The pair of projection portions 322 and 324 project outward from opposite ends of the sheet guide member 32 in the first direction D1, along a straight line extending in the first direction D1. The pair of projection portions 322 and 324 are rotatably supported. This allows the sheet guide member 32 to be supported so as to be able to swing around the pair of projection portions 322 and 324.

In the following description, one of the pair of projection portions 322 and 324 is referred to as a first projection portion 322, and the other is referred to as a second projection portion 324.

The actuator 33 includes a main body 331 and a displacement portion 332 that extends out from the main body 331. The displacement portion 332 is configured to be displaced reciprocally. The actuator 33 displaces the displacement portion 332 in accordance with an input control signal. For example, the actuator 33 is a solenoid.

The displacement portion 332 of the actuator 33 is coupled with the sheet guide member 32. This allows the actuator 33 to hold the sheet guide member 32 selectively in one of two different attitudes by swinging the sheet guide member 32. With the configuration where the sheet guide member 32 is held in two different attitudes, the sheet guide member 32 can guide the sheet 9 in two different directions. That is, the sheet guide member 32 switches between two directions to guide the sheet 9 by swinging around the pair of projection portions 322 and 324.

As shown in FIG. 1 and FIG. 2, the sheet detecting member 51 includes a main shaft portion 511, a contact portion 512, and a detected portion 513. The sheet detecting member 51 further includes balancers 514.

Figure 4:
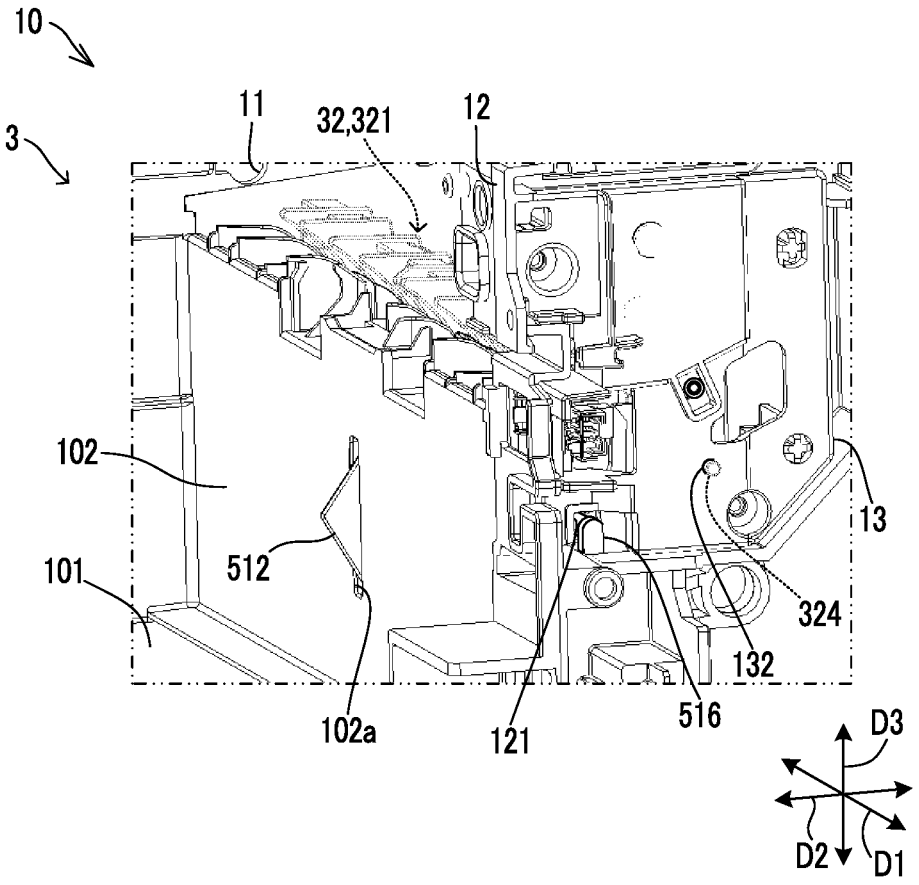
FIG. 4 is a perspective diagram of a part of the image forming apparatus of the embodiment in which the sheet detecting member is disposed.

The main shaft portion 511 is disposed along the first direction D1, and is rotatably supported. That is, the main shaft portion 511 is formed to extend in the first direction D1. The contact portion 512 and the detected portion 513 are formed to extend from the main shaft portion 511 outward in the radial direction of the main shaft portion 511. As shown in FIG. 1, FIG. 2, and FIG. 4, the contact portion 512 is formed to extend from the main shaft portion 511 toward above the discharge tray 101.

As shown in FIG. 2, the contact portion 512 and the detected portion 513 are formed to project in different directions from the main shaft portion 511. Similar to the contact portion 512 and the detected portion 513, the balancers 514 are formed to extend from the main shaft portion 511.

A torque around the main shaft portion 511 by the load of the balancers 514 and a torque around the main shaft portion 511 by the load of the contact portion 512 and the detected portion 513 are balanced. This allows the sheet detecting member 51 to be supported so as to be freely rotatable around the main shaft portion 511 and held in a predetermined attitude in a natural state in which no external force is applied.

FIG. 2 and FIG. 4 show the sheet detecting member 51 in the natural state where the torque by the load of the balancers 514 and the torque by the load of the contact portion 512 and the detected portion 513 are balanced. It is noted that for convenience's sake, in FIG. 4 and FIG. 5, the sheet guide member 32 is indicated by a dotted line.

As shown in FIG. 4, a wall 102 is provided erecting at an end of the discharge tray 101 on the upstream side in a sheet discharge direction. The wall 102 separates between a space above the discharge tray 101 and a space of the main body portion 1 in which the sheet detecting member 51 is disposed.

The wall 102 has a slit 102*a*, and a part of the plate-like contact portion 512 protrudes from the slit 102*a* into above the discharge tray 101.

When sheets 9 are stacked on the discharge tray 101 in excess of a predetermined threshold height, the rear end of the sheets 9 comes in contact with the contact portion 512. This allows the contact portion 512 to receive a contact pressure from the sheets 9 stacked in excess of the threshold height on the tray.

When the contact portion 512 comes in contact with the sheets 9 stacked on the discharge tray 101, the sheet detecting member 51 rotates around the main shaft portion 511. When the sheet detecting member 51 rotates, the detected portion 513 rotates around the main shaft portion 511, too.

The detection sensor 52 detects the detected portion 513 when the sheet detecting member 51 rotates in excess of a predetermined threshold angle upon receiving the contact pressure from the sheets 9 on the discharge tray 101.

In the present embodiment, the detection sensor 52 is a transmission-type optical sensor. The optical sensor includes a light emitting portion and a light receiving portion that are disposed to face each other. When the sheet detecting member 51 rotates in excess of the threshold angle, the detected portion 513 blocks the light that has been emitted from the light emitting portion toward the light receiving portion. This allows the optical sensor to detect the detected portion 513.

The sheet detecting member 51 and the sheet guide member 32 are disposed such that their longitudinal directions match the first direction D1 (see FIG. 2, FIG. 3).

Meanwhile, the sheet guide member 32 that guides the sheet 9 in a predetermined direction may be swingably supported in parallel with the sheet detecting member 51. In the present embodiment, the sheet guide member 32 and the sheet detecting member 51 are disposed at relatively close positions in parallel with each other via the conveyance path 300. In this case, the work to assemble the sheet detecting member 51 and the sheet guide member 32 in the sheet detecting member 51 is difficult.

Specifically, in a case where the sheet detecting member 51 has already been mounted to the main body portion 1, a finger of the worker or the like may contact and swing the sheet detecting member 51 during the process of mounting the sheet guide member 32 to the main body portion 1.

A large swinging of the sheet detecting member 51 during the mounting work of the sheet guide member 32 causes the contact portion 512 or the detected portion 513 to collide with a surrounding component such as the detection sensor 52 or the sheet guide member 32.

The collision may cause a damage of the component. In addition, it is difficult to mount the sheet guide member 32 to the main body portion 1 without causing such a collision.

It is noted that a similar problem may occur when the sheet detecting member 51 is mounted to the main body portion 1 after the sheet guide member 32 is mounted to the main body portion 1.

The sheet conveying device 3 of the image forming apparatus 10 has a structure that, in a case where the sheet detecting member 51 that is rotatably supported and the sheet guide member 32 that is swingably supported are disposed in parallel with each other, facilitates mounting the sheet detecting member 51 and the sheet guide member 32 to the main body portion 1. The following describes the structure.

[Mounting Structure of Sheet Detecting Member 51 and Sheet Guide Member 32]

Figure 5:
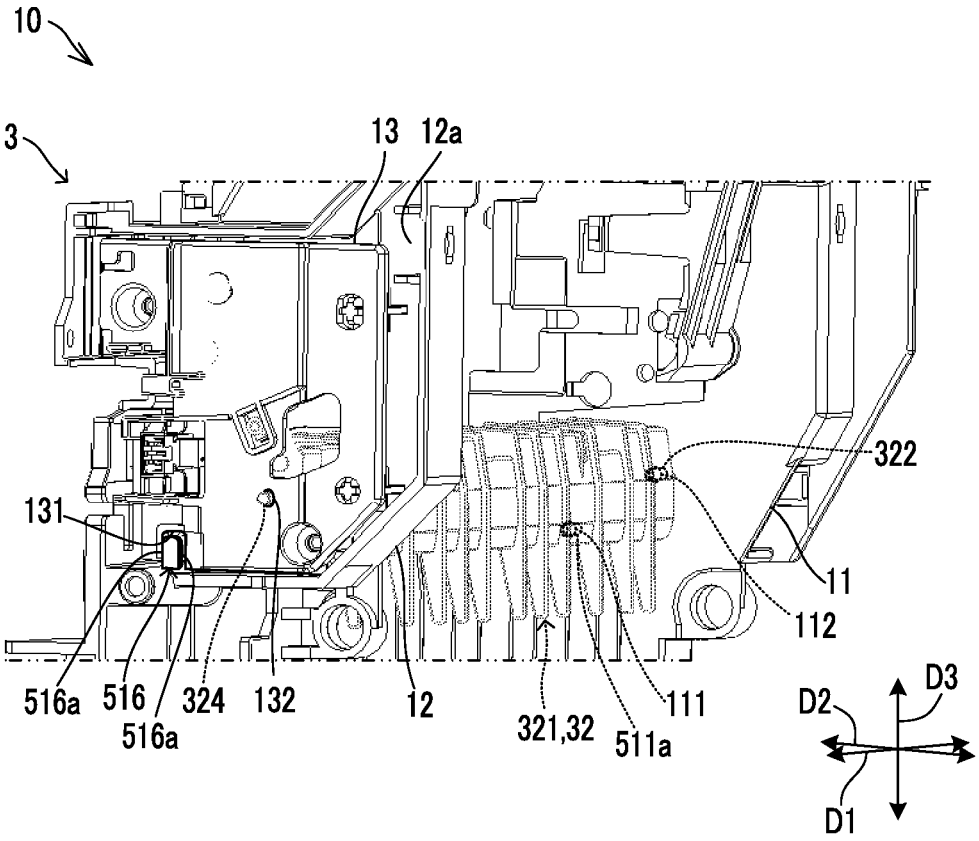
FIG. 5 is a perspective diagram of a part of the image forming apparatus of the embodiment in which the sheet guide member is disposed.

As shown in FIG. 5, the sheet conveying device 3 further includes a first side plate 11, a second side plate 12, and an attachment member 13.

The first side plate 11 and the second side plate 12 are a part of the main body portion 1. The first side plate 11 and the second side plate 12 are disposed to face each other in the first direction D1. The first side plate 11 is disposed on the side of a first end of the main shaft portion 511 in the first direction D1, and the second side plate 12 is disposed on the side of a second end of the main shaft portion 511 in the first direction D1.

As shown in FIG. 2, the main shaft portion 511 of the sheet detecting member 51 includes a first supported portion 511*a* and a second supported portion 511*b*, wherein the first supported portion 511*a* is rotatably supported by the first side plate 11, and the second supported portion 511*b* is rotatably supported by the second side plate 12.

The first supported portion 511*a* is formed at the first end of the main shaft portion 511. The first end of the main shaft portion 511 is opposite to the second end of the main shaft portion 511. The second end of the main shaft portion 511 is on the detected portion 513 side. The second supported portion 511*b* is a portion of the main shaft portion 511 located between the detected portion 513 and the contact portion 512. More specifically, the second supported portion 511*b* is located between the detected portion 513 and the contact portion 512, and is close to the detected portion 513.

As shown in FIG. 5, the first side plate 11 is a plate-like member in which a first detection-related hole 111 and a first guide-related hole 112 are formed. The first detection-related hole 111 is a hole in which the first supported portion 511*a* of the sheet detecting member 51 is inserted. The first guide-related hole 112 is a hole in which the first projection portion 322 of the sheet guide member 32 is inserted. It is noted that the first detection-related hole 111 is an example of a first support hole, and the first guide-related hole 112 is an example of a second support hole.

As shown in FIG. 5, the attachment member 13 is mounted to an outer surface 12*a* of the second side plate 12. The outer surface 12*a* of the second side plate 12 is on the opposite side from a surface of the second side plate 12 that faces the first side plate 11.

Figure 11:
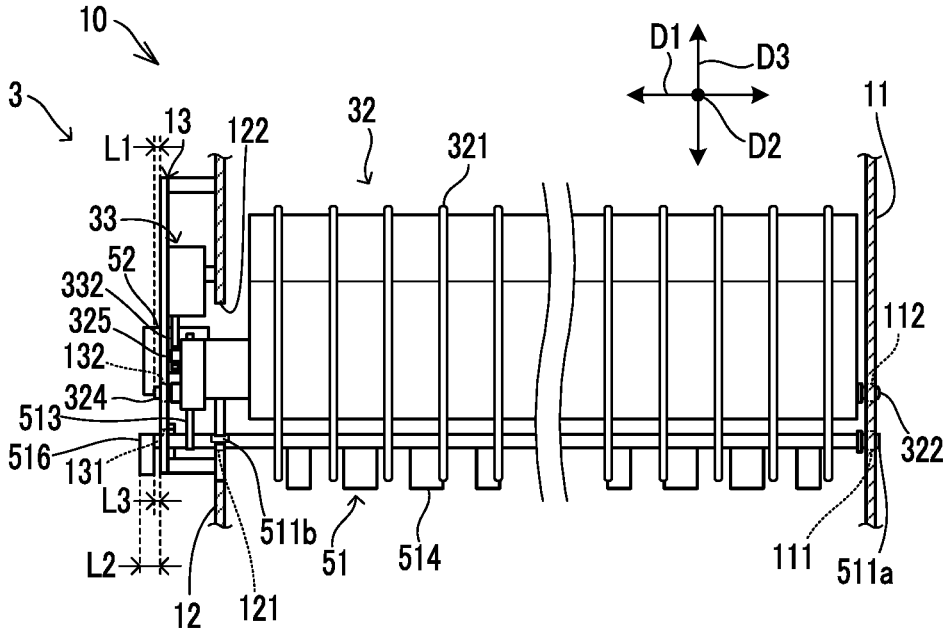
FIG. 11 is a partial sectional front diagram of a part of the image forming apparatus of the embodiment in which the sheet detecting member and the sheet guide member are disposed.

As shown in FIG. 11, the attachment member 13 is mounted to the second side plate 12 with screws or the like such that a space in which the detected portion 513 of the sheet detecting member 51 is disposed is formed between the attachment member 13 and the outer surface 12*a* of the second side plate 12.

In addition, as shown in FIG. 11, the detection sensor 52 is disposed to straddle the space between the second side plate 12 and the attachment member 13 and a space outside the attachment member 13. In the space between the second side plate 12 and the attachment member 13, the detection sensor 52 detects the detected portion 513 when the sheet detecting member 51 rotates in excess of the threshold angle. That is, the attachment member 13 forms a space between the attachment member 13 and the second side plate 12 such that the detection sensor 52 is disposed in the space.

In addition, as shown in FIG. 11, the actuator 33 is disposed in the space between the second side plate 12 and the attachment member 13.

Figure 10:
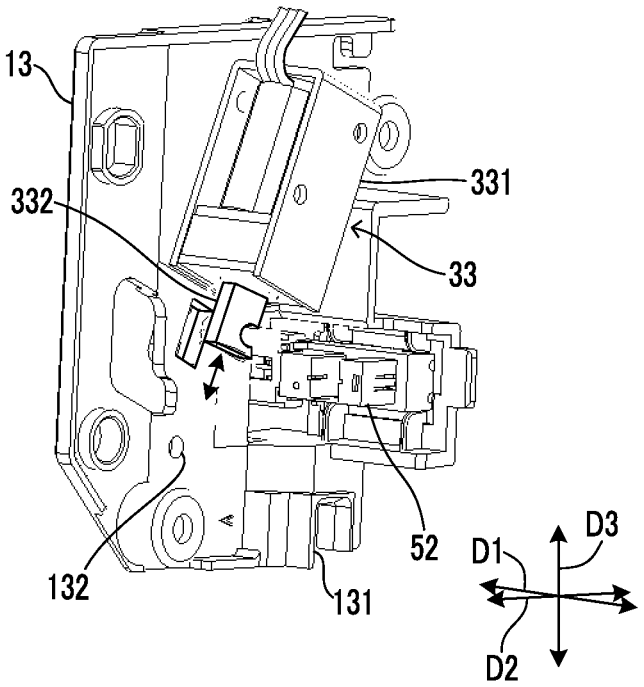
FIG. 10 is a perspective diagram of a unit including the attachment member in the image forming apparatus according to the embodiment.

As shown in FIG. 10, the detection sensor 52 and the actuator 33 are first mounted to the attachment member 13. This allows the attachment member 13 to be unitized with the detection sensor 52 and the actuator 33. Thereafter, the unit of the attachment member 13 is mounted to the second side plate 12.

Figure 6:
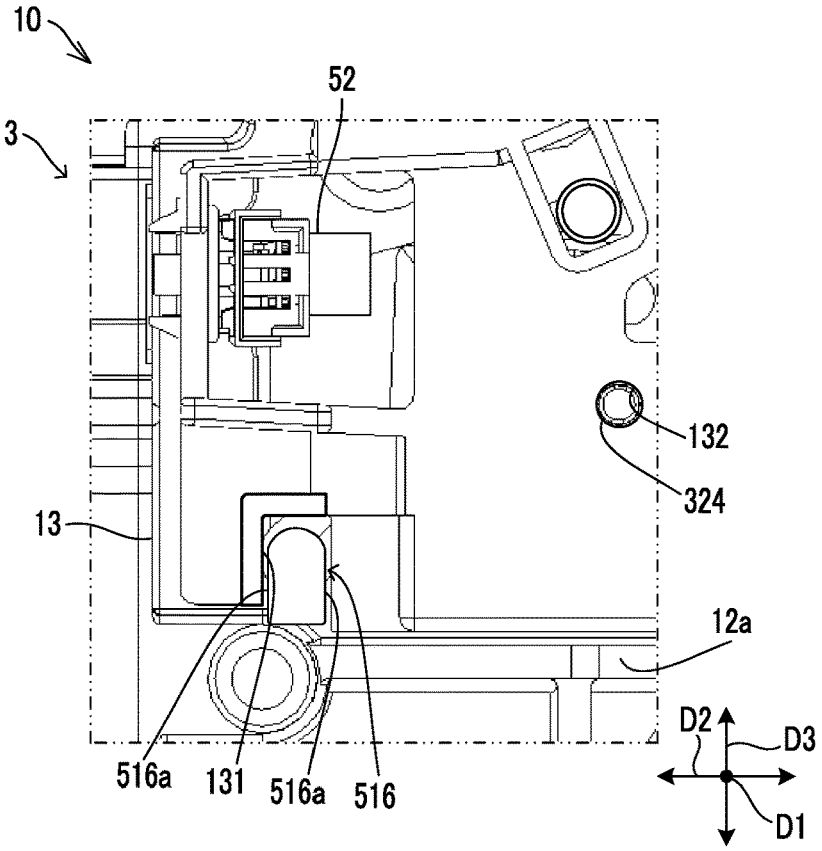
FIG. 6 is a front diagram of a part of the image forming apparatus of the embodiment in which an attachment member is disposed.

As shown in FIG. 5 and FIG. 6, a restriction opening 131 and a second guide-related hole 132 are formed in the attachment member 13. In addition, as shown in FIG. 2, the sheet detecting member 51 further includes a flange portion 516.

As shown in FIG. 4 to FIG. 6, the second guide-related hole 132 of the attachment member 13 is a hole in which the second projection portion 324 of the sheet guide member 32 is inserted. The second guide-related hole 132 is an example of a fourth support hole.

Figure 7:
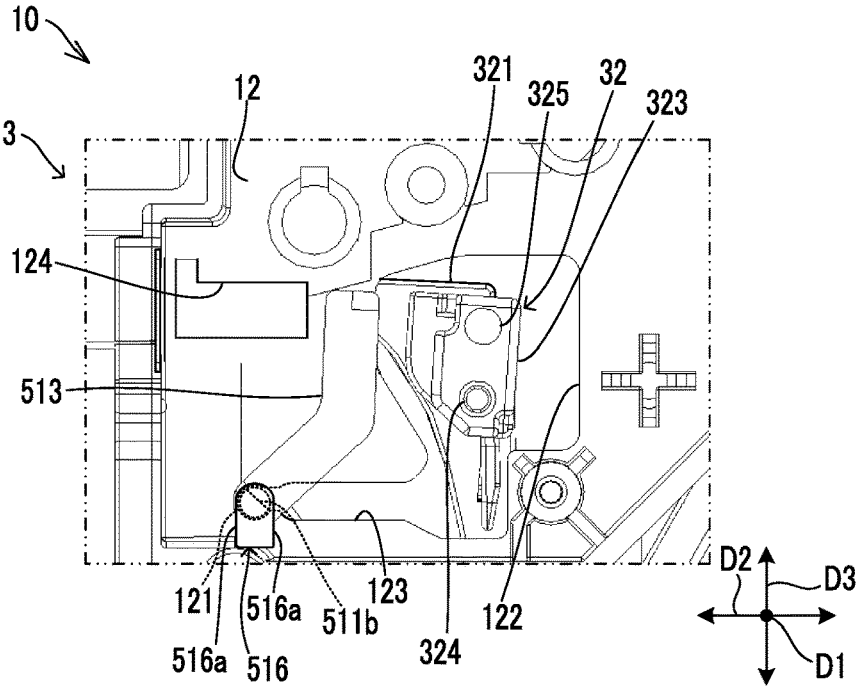
FIG. 7 is a front diagram of a part of the image forming apparatus of the embodiment in which a second side plate is disposed.
Figure 8:
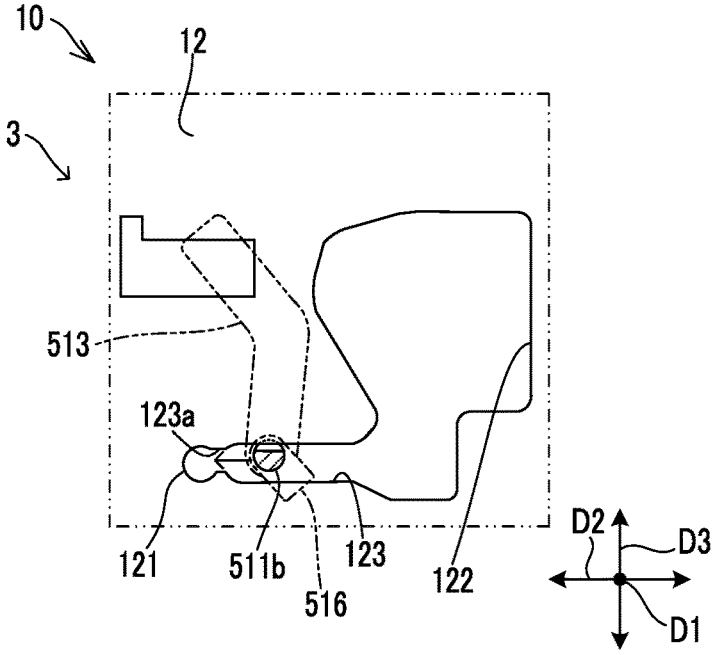
FIG. 8 is a diagram showing a process during which a second supported portion of the sheet detecting member is supported by the second side plate in the image forming apparatus according to the embodiment.

FIG. 7 and FIG. 8 show portions of the second side plate 12 before the attachment member 13 is mounted thereto. As shown in FIG. 7 and FIG. 8, a second detection-related hole 121, a large opening 122, and a communication opening 123 are formed in the second side plate 12.

The second detection-related hole 121 is a hole in which the second supported portion 511*b* of the main shaft portion 511 of the sheet detecting member 51 is inserted. The second detection-related hole 121 is an example of a third support hole. The large opening 122 is larger than the second detection-related hole 121.

More specifically, the large opening 122 is formed such that the contact portion 512 and the balancers 514 of the sheet detecting member 51 can pass therethrough. Since the large opening 122 is formed in the second side plate 12, a hole in which the second projection portion 324 of the sheet guide member 32 is inserted cannot be formed in the second side plate 12.

That is, when viewed in the first direction D1, the large opening 122 is formed in a region in which the second projection portion 324 of the sheet guide member 32 is included.

When the sheet detecting member 51 is mounted to the main body portion 1, the sheet detecting member 51 is inserted in the large opening 122 from outside the second side plate 12, with the first supported portion 511*a* at the head. In addition, the first supported portion 511*a* is inserted in the first detection-related hole 111 of the first side plate 11. At this time, the first supported portion 511*a* is inserted in the first detection-related hole 111 in a state where the sheet detecting member 51 is inclined in the second direction D2 with respect to the first direction D1.

The communication opening 123 is communicated with the large opening 122 and the second detection-related hole 121. The communication opening 123 is formed between the large opening 122 and the second detection-related hole 121 to extend in the second direction D2.

The communication opening 123 is formed such that the second supported portion 511*b* of the main shaft portion 511 inserted in the large opening 122 can pass through the communication opening 123 to the second detection-related hole 121.

As shown in FIG. 8, when viewed in the first direction D1, the shape of the contour of the second supported portion 511*b* is a partially cut circle. With the second supported portion 511*b* shaped in this way, the size of the second supported portion 511*b* in the third direction D3 when the sheet detecting member 51 is not in the natural state but is inclined by a predetermined angle in a rotation direction around the main shaft portion 511, is smaller than the size of the second supported portion 511*b* in the third direction D3 when the sheet detecting member 51 is in the natural state.

FIG. 8 shows a cross section of the second supported portion 511*b* in the state where the sheet detecting member 51 is inclined by the predetermined angle.

In addition, an end of the communication opening 123 on the second detection-related hole 121 side is a narrowing portion 123*a* that is narrower in width than the other portions. The width of the narrowing portion 123*a* in the third direction D3 is larger than the size of the second supported portion 511*b* in the third direction D3 when the sheet detecting member 51 is inclined with a specific orientation, and is smaller than the size of the second supported portion 511*b* in the third direction D3 when the sheet detecting member 51 is in the natural state.

Accordingly, as shown in FIG. 8, when the sheet detecting member 51 is mounted to the main body portion 1, the second supported portion 511*b* is moved from inside the large opening 122 through the communication opening 123 to the second detection-related hole 121 while the sheet detecting member 51 is inclined with the specific orientation.

Subsequently, in a state where the sheet detecting member 51 rotates from the natural state to the threshold angle, the second supported portion 511*b* cannot be moved from the second detection-related hole 121 to the communication opening 123.

It is noted that the first supported portion 511*a* is cylindrical, and the first detection-related hole 111 is circular. In addition, a portion of the second supported portion 511*b* having an arc shape in cross section is supported by an edge portion of an arc shape of the second detection-related hole 121.

In addition, as shown in FIG. 3, the sheet guide member 32 includes an end portion 323 at an end in the first direction D1. The end portion 323 projects in the first direction D1 from an end of the guide portion 321 that is opposite to an end of the guide portion 321 on the first projection portion 322 side.

In the end portion 323, the second projection portion 324 and a coupling portion 325 are formed in parallel to project in the first direction D1. The coupling portion 325 is coupled with the displacement portion 332 of the actuator 33.

The large opening 122 is formed to be large enough for the end portion 323 to pass through (see FIG. 7). In a state where the sheet guide member 32 is mounted to the main body portion 1, the end portion 323 passes through the large opening 122 of the second side plate 12 (see FIG. 11).

As shown in FIG. 2, the flange portion 516 is formed at an end of the main shaft portion 511 that is opposite to an end of the main shaft portion 511 on the first supported portion 511*a* side. The flange portion 516 is formed to extend, at the second end of the main shaft portion 511, from the main shaft portion 511 outward in the radial direction of the main shaft portion 511.

In addition, as shown in FIG. 5 and FIG. 11, the flange portion 516 is formed at a position on the main shaft portion 511 in a side opposite to the second supported portion 511*b* across the attachment member 13 in the first direction D1. That is, the flange portion 516 is located outside the attachment member 13 on the main shaft portion 511. In other words, when the attachment member 13 is mounted to the second side plate 12, the flange portion 516 is disposed in a side opposite to the second supported portion 511*b* across the attachment member 13 in the first direction D1. That is, the flange portion 516 is disposed outside the attachment member 13.

As shown in FIG. 5 to FIG. 7, the flange portion 516 includes specific surfaces 516*a*, wherein at least part of a contour of each of the specific surfaces 516*a* when viewed in the first direction D1 has a non-arc shape. When viewed in the first direction D1, outside the contour of the main shaft portion 511 in the radial direction of the main shaft portion 511, the specific surfaces 516*a* are not shaped along an arc centering on the main shaft portion 511.

In the present embodiment, the specific surfaces 516*a* are a pair of planes that are parallel to each other in the first direction D1.

Figure 9:
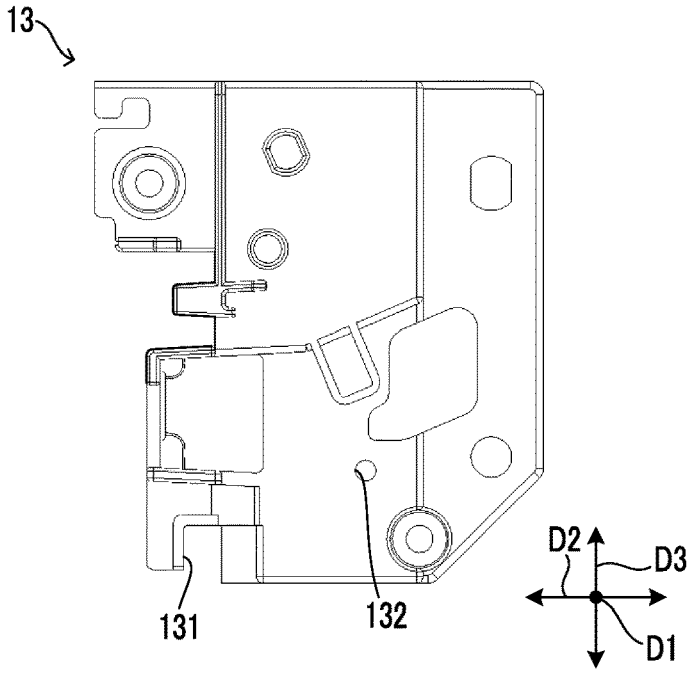
FIG. 9 is a front diagram of the attachment member in the image forming apparatus according to the embodiment.

As shown in FIG. 6 and FIG. 9, when viewed in the first direction D1, the restriction opening 131 forms an inner surface along the specific surfaces 516*a* of the flange portion 516. In the present embodiment, the restriction opening 131 is a dent that cuts into from a lower edge of the attachment member 13. The restriction opening 131 is formed such that the flange portion 516 can be fitted in the restriction opening 131, and is an example of a restriction slot through which the flange portion 516 can pass.

In the following description, a side of the attachment member 13 that faces the second side plate 12 is referred to as an inner side, and a side opposite from the inner side is referred to as an outer side.

As shown in FIG. 11, in a state where the attachment member 13 is mounted to the second side plate 12, the flange portion 516 is on the outer side of the restriction opening 131.

In addition, as shown in FIG. 11, the length of a portion of the second projection portion 324 that projects to outside the attachment member 13 in the first direction D1 is referred to as a first length L1. The first length L1 is a distance from an outer surface of the attachment member 13 to a tip of the second projection portion 324 in the first direction D1.

Similarly, at outside the attachment member 13, a length in the first direction D1 from a position on the main shaft portion 511 immediately out of the restriction opening 131 to an end surface of the flange portion 516 on a side opposite from the second supported portion 511*b*, is referred to as a second length L2. In addition, a length in the first direction D1 from the position on the main shaft portion 511 immediately out of the restriction opening 131 to an end surface of the flange portion 516 on the second supported portion 511*b* side, is referred to as a third length L3. The third length L3 is equal to an interval between the attachment member 13 and the flange portion 516 in the first direction D1.

The first length L1 is shorter than the second length L2. Furthermore, the first length L1 may be larger than the third length L3. In this case, in a state where the attachment member 13 is at the second position, a distance in the first direction D1 from the outer surface of the attachment member 13 to a tip of the second projection portion 324 of the sheet guide member 32 is equal to or larger than an interval in the first direction D1 between the outer surface of the attachment member 13 and the flange portion 516. In the example shown in FIG. 11, the first length L1 is equal to the third length L3.

The following describes a procedure to assemble the sheet guide member 32 and the sheet detecting member 51 in the main body portion 1, with reference to FIG. 11 to FIG. 14.

Figure 12:
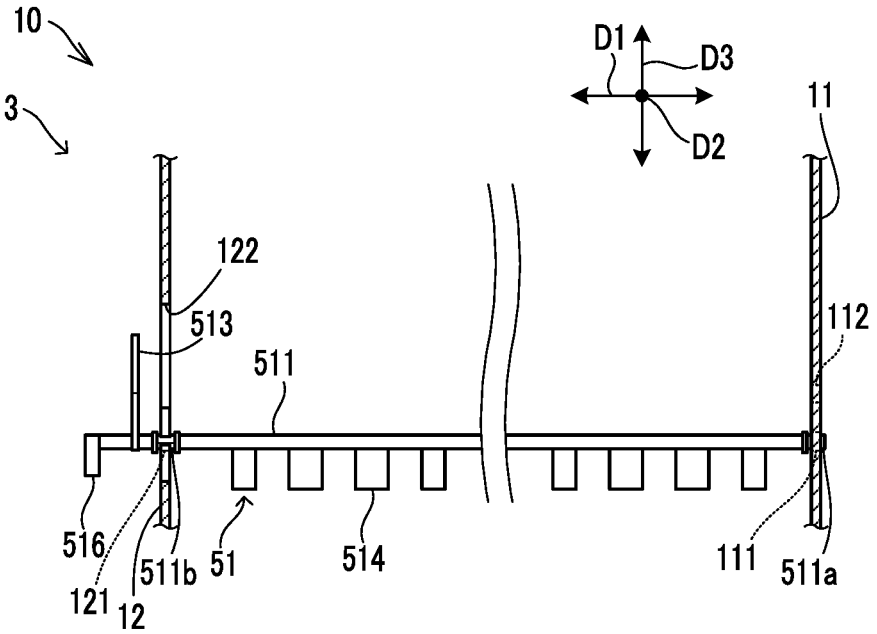
FIG. 12 is a front diagram of a part of the image forming apparatus of the embodiment in which the sheet detecting member is disposed (before the sheet guide member is mounted).

As shown in FIG. 12, first the sheet detecting member 51 is inserted in the large opening 122 from outside the second side plate 12 with the first supported portion 511*a* at the head. Subsequently, the first supported portion 511*a* is inserted in the first detection-related hole 111 of the first side plate 11, and the second supported portion 511*b* is moved from the large opening 122 through the communication opening 123 to the second detection-related hole 121 in the second direction D2 of the second side plate 12. This allows the second supported portion 511*b* to be inserted in the second detection-related hole 121. It is noted that when the first supported portion 511*a* is inserted in the first detection-related hole 111 of the first side plate 11, the contact portion 512 can pass through the large opening 122.

Figure 13:
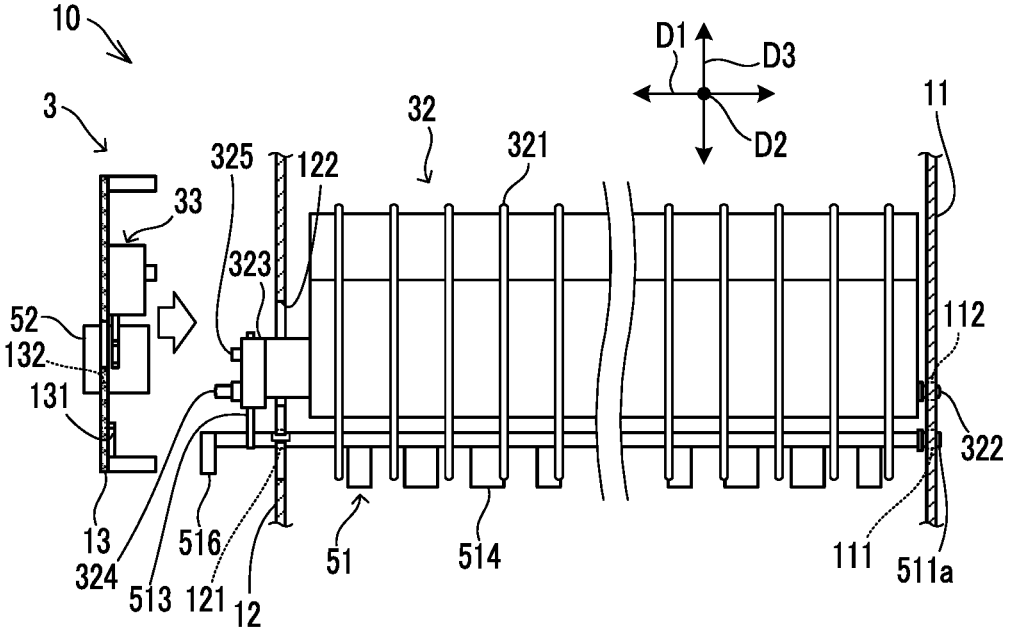
FIG. 13 is a front diagram of a part of the image forming apparatus of the embodiment in which the sheet detecting member is disposed (before the attachment member is mounted).

Next, as shown in FIG. 13, the end portion 323 of the sheet guide member 32 is inserted in the large opening 122 of the second side plate 12, and the first projection portion 322 of the sheet guide member 32 is inserted in the first guide-related hole 112 of the first side plate 11. That is, when the first projection portion 322 of the sheet guide member 32 is inserted in the first guide-related hole 112 of the first side plate 11, the end portion 323 can pass through the large opening 122.

Furthermore, as shown in FIG. 13, the attachment member 13 is made to approach the second side plate 12 in the first direction D1. The attachment member 13 is moved in the first direction D1 to pass a predetermined first position until it reaches a second position, thereby the attachment member 13 is mounted to an outer surface of the second side plate 12. The second position is a position at which the attachment member 13 is mounted to the second side plate 12. The first position is more separated from the outer surface of the attachment member 13 than the second position. It is noted that the detection sensor 52 and the actuator 33 have been mounted to the attachment member 13 in advance.

Figure 14:
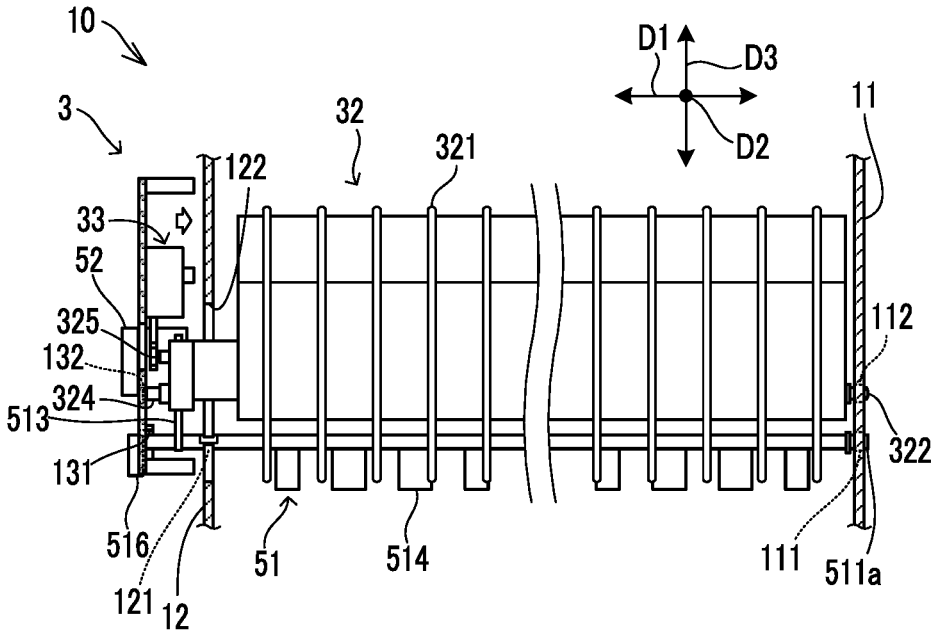
FIG. 14 is a front diagram of the part of the image forming apparatus of the embodiment in which the sheet detecting member is disposed (during a process of mounting the attachment member).

Subsequently, as shown in FIG. 14, the attachment member 13 is made to further approach the second side plate 12 in the first direction D1. In this state, when the attachment member 13 passes the first position, the flange portion 516 is fitted in the restriction opening 131, and the second projection portion 324 is inserted in the second guide-related hole 132.

Here, as shown in FIG. 11, the first length L1 is shorter than the second length L2. As a result, when the attachment member 13 is made to approach the second side plate 12 in the first direction D1, first the flange portion 516 is fitted in the restriction opening 131. At this time, the flange portion 516 that is freely rotatable is rotated to an orientation in which it can be fitted in the restriction opening 131, and guided to the restriction opening 131.

When the flange portion 516 is fitted in the restriction opening 131, the sheet detecting member 51 is restricted from rotating by the restriction opening 131. FIG. 14 shows a state where the sheet detecting member 51 is restricted from rotating by the restriction opening 131 while the flange portion 516 is passing through the restriction opening 131.

After the sheet detecting member 51 is restricted from rotating by the restriction opening 131, the second projection portion 324 is inserted in the second guide-related hole 132. At this time, the second projection portion 324 of the sheet guide member 32 that has not been positioned is guided to the second guide-related hole 132 of the attachment member 13 by a human hand. Thereafter, the attachment member 13 is mounted to the second side plate 12.

That is, in the middle of the process where the attachment member 13 is mounted to the second side plate 12 in the first direction D1, the flange portion 516 is fitted in the restriction opening 131 such that the sheet detecting member 51 is restricted from rotating, and the second projection portion 324 is inserted in the second guide-related hole 132. That is, when the attachment member 13 passes the first position, the flange portion 516 is fitted in the restriction opening 131, and the second projection portion 324 is inserted in the second guide-related hole 132 in a state where the sheet detecting member 51 is restricted from rotating. Furthermore, after the attachment member 13 passes the first position and before it reaches the second position, the flange portion 516 passes through the restriction opening 131 and is disposed outside the attachment member 13. This releases the restriction on the rotation of the sheet detecting member 51.

Accordingly, the above-described configuration restricts the sheet detecting member 51 from contacting a finger of the worker or the like and swinging, and allows the second projection portion 324 to be inserted in the second guide-related hole 132 easily.

Here, as shown in FIG. 11, the first length L1 is equal to or larger than the third length L3. As a result, when the unit of the attachment member 13 is made to approach the second side plate 12 in the first direction D1, the tip of the second projection portion 324 is inserted in the second guide-related hole 132 before the whole flange portion 516 passes through the restriction opening 131.

That is, it is possible to insert the tip of the second projection portion 324 in the second guide-related hole 132 in a reliable manner while the sheet detecting member 51 is restricted from rotating by the restriction opening 131. On the other hand, the coupling portion 325 is coupled with the displacement portion 332 of the actuator 33.

In addition, as shown in FIG. 11, when the attachment member 13 is mounted to the second side plate 12 after the second projection portion 324 is inserted in the second guide-related hole 132, the flange portion 516 passes through the restriction opening 131. This results in the release of the restriction of the rotation of the sheet detecting member 51 by the restriction opening 131.

That is, in a state where the attachment member 13 is mounted to the second side plate 12, the flange portion 516 is disposed in a side opposite to the second side plate 12 across the restriction opening 131 in the first direction D1. This releases the restriction of the rotation of the sheet detecting member 51.

With the adoption of the image forming apparatus 10, the sheet detecting member 51 is restricted from swinging during the mounting work of the sheet guide member 32. As a result, it becomes easy to mount the sheet detecting member 51 and the sheet guide member 32 to the main body portion 1.

In addition, during the mounting work of the sheet guide member 32, the contact portion 512 or the detected portion 513 is avoided from colliding with a surrounding component such as the detection sensor 52 or the sheet guide member 32.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device comprising:

a pair of conveyance rollers configured to convey a sheet onto a tray;

a sheet detecting member including a main shaft portion, a contact portion, and a detected portion, the main shaft portion being formed to extend in a main direction perpendicular to a sheet conveyance direction in which the sheet is conveyed, the contact portion and the detected portion being formed to extend in different directions from the main shaft portion, the sheet detecting member rotating around the main shaft portion while the contact portion comes in contact with the sheet stacked on the tray;

a sheet guide member disposed parallel with the sheet detecting member and including a guide portion, a first projection portion, and a second projection portion, the guide portion guiding the sheet that is being conveyed, the first projection portion and the second projection portion projecting in the main direction respectively from opposite ends of the guide portion in the main direction, the sheet guide member being supported in such a way as to swing around the first projection portion and the second projection portion and change directions to guide the sheet;

a first side plate in which a first support hole and a second support hole are formed, wherein a first supported portion formed at a first end of the main shaft portion is inserted in the first support hole, and the first projection portion is inserted in the second support hole;

a second side plate disposed to face the first side plate in the main direction;

an attachment member mounted to an outer surface of the second side plate; and a detection sensor configured to detect the detected portion, wherein a third support hole, a large opening, and a communication opening are formed in the second side plate, wherein a second supported portion formed on a side of a second end of the main shaft portion is inserted in the third support hole, the large opening is larger than the third support hole, the communication opening is communicated with the large opening and the third support hole, and the second supported portion passes through the communication opening, a fourth support hole in which the second projection portion is inserted is formed in the attachment member, the attachment member forms a space between the attachment member and the second side plate such that the detection sensor is disposed in the space, the sheet detecting member includes:

a flange portion disposed outside the attachment member and formed to extend, at the second end of the main shaft portion, from the main shaft portion outward in a radial direction of the main shaft portion, a restriction slot is formed in the attachment member such that the flange portion can be fitted in and pass through the restriction slot, the attachment member is moved in the main direction to pass a first position until it reaches a second position, thereby the attachment member is mounted to the second side plate, when the attachment member passes the first position, the flange portion is fitted in the restriction slot, and the second projection portion is inserted in the fourth support hole in a state where the sheet detecting member is restricted from rotating, and after the attachment member passes the first position and before it reaches the second position, the flange portion passes through the restriction slot and is disposed outside the attachment member, thereby the sheet detecting member can be rotated.

2. The sheet conveying device according to claim 1, wherein in a state where the attachment member is at the second position, a distance in the main direction from an outer surface of the attachment member to a tip of the second projection portion is equal to or larger than an interval in the main direction between the outer surface of the attachment member and the flange portion.

3. The sheet conveying device according to claim 1, wherein when the first supported portion of the sheet detecting member is inserted in the first support hole of the first side plate, the contact portion can pass through the large opening.

4. The sheet conveying device according to claim 1, further comprising:

an actuator disposed between the second side plate and the attachment member, the actuator including a displacement portion configured to be displaced reciprocally, and displacing the displacement portion in accordance with an input control signal, wherein the sheet guide member includes:

an end portion that is provided at an end of the sheet guide member in the main direction, and includes the second projection portion and a coupling portion that is provided in parallel with the second projection portion and is coupled with the displacement portion, and when the first projection portion of the sheet guide member is inserted in the second support hole of the first side plate, the end portion can pass through the large opening.

5. The sheet conveying device according to claim 1, wherein the flange portion is formed at the second end of the main shaft portion that is opposite to the first end of the main shaft portion on the first supported portion side.

6. An image forming apparatus comprising:

the sheet conveying device according to claim 1; and a print device configured to form an image on a sheet conveyed by the sheet conveying device.

* * * * *